US005896678A

United States Patent [19]

Ganon

[11] Patent Number: 5,896,678

[45] Date of Patent: Apr. 27, 1999

[54] RESILIENT SANDAL WEDGE AND SANDAL FORMED THEREWITH

[75] Inventor: Michael H. Ganon, Blacklick, Ohio

[73] Assignee: totes Isotoner Corporation, Loveland, Ohio

[21] Appl. No.: 09/045,430

[22] Filed: Mar. 20, 1998

Related U.S. Application Data

[63] Continuation of application No. 08/747,780, Nov. 14, 1996, abandoned.

[51] Int. Cl.[6] ..... A43B 3/12; A43B 21/32

[52] U.S. Cl. ..... 36/11.5; 36/37; 36/35 R; 36/35 B

[58] Field of Search ..... 36/11.5, 37, 35 R, 36/35 B, 28, 29, 3 B

[56] References Cited

U.S. PATENT DOCUMENTS

| | | | |
|---|---|---|---|
| Re. 13,150 | 9/1910 | Byrne . | |
| D. 112,267 | 11/1938 | Court | D2/965 |
| D. 350,226 | 9/1994 | Kilgore | D2/964 |
| D. 362,745 | 10/1995 | Skrivanek | D2/916 |
| 564,767 | 7/1896 | Scheider . | |
| 588,977 | 8/1897 | Gilbert . | |
| 968,434 | 8/1910 | Taillefer | 36/38 |
| 1,456,843 | 5/1923 | Clark | 36/37 |
| 1,517,170 | 11/1924 | Rosenthal . | |
| 1,780,997 | 11/1930 | Cohan et al. | 36/37 |
| 2,150,385 | 3/1939 | Maling | 36/35 R X |
| 2,326,790 | 8/1943 | Margolin | 36/37 X |
| 2,433,329 | 12/1947 | Adler et al. . | |
| 2,581,864 | 1/1952 | Kaufmann Jr. . | |
| 2,724,912 | 11/1955 | Silombra | 36/11.5 |
| 3,984,926 | 10/1976 | Calderon | 36/37 |
| 4,223,456 | 9/1980 | Cohen | 36/59 |
| 4,513,518 | 4/1985 | Jalbert | 36/43 X |
| 4,715,130 | 12/1987 | Scatena | 36/27 |

FOREIGN PATENT DOCUMENTS

| | | | |
|---|---|---|---|
| 111476 | 9/1940 | Australia | 36/11.5 |
| 606634 | 8/1960 | Italy | 36/11.5 |
| 625880 | 9/1961 | Italy | 36/11.5 |
| 647998 | 12/1950 | United Kingdom | 36/35 |

*Primary Examiner*—Ted Kavanaugh
*Assistant Examiner*—Simon S. Hart
*Attorney, Agent, or Firm*—Wood, Herron & Evans, LLP

[57] ABSTRACT

A resilient sandal wedge usable with a sandal formed from a sole and a vamp such as retaining straps and the like and the sandal formed therewith, the wedge having a wedge-shaped body portion, a substantially flat bottom portion, a recess defining the junction of the body and bottom portions, and a plurality of recesses extending from the bottom portion lower surface through the bottom portion and partially through the body portion to provide a cushioning resiliency to the wedge when the sandal user applies pressure on the wedge while walking or running.

20 Claims, 1 Drawing Sheet

RESILIENT SANDAL WEDGE AND SANDAL FORMED THEREWITH

This application is a continuation of application Ser. No. 08/747,780, filed on Nov. 14, 1996, now abandoned, which is incorporated herein by reference in its entirety.

BACKGROUND OF THE INVENTION—FIELD OF THE INVENTION

This invention relates to sandals and more particularly to a resilient sandal wedge used to form a sandal having a sole and a vamp and the sandal formed therewith.

BACKGROUND OF THE INVENTION—DESCRIPTION OF THE PRIOR ART

Sandals with wedge portions have traditionally embodied solid materials for wedges such as wood covered with fabric or an appropriate light but substantially rigid plastic material. These wedges have been covered with foam rubber and fabric to provide some cushioning effect; however, they are still unyielding during use and therefore not as comfortable as a user might wish, especially since they are usually a casual shoe worn during times of relaxation.

While consumers have generally accepted the traditional "wedgie" shoe for casual use, there is still a desire for additional comfort and supporting structure that would allow a user to wear the shoes for a considerable longer period of time. It is to this body of users that the present invention is directed.

SUMMARY AND OBJECTIVES OF THE INVENTION

The present invention overcomes the undesired features of conventional "wedgies" in that it, for the first time, enables the use of a flexible and resilient material for the wedge that, because of its design and material, absorbs the shock and provides support when the user is walking and running. The wedge is resilient and contains a wedge-shaped body portion, a substantially flat bottom portion adjacent the body portion, a recess defining the junction of the body portion and the bottom portion, and a plurality of recesses extending from the bottom portion lower surface through the bottom portion and partially through the body portion, thus providing cushioning resiliency when the user applies pressure on the wedge during walking or running.

From the brief description given, it can be appreciated that a primary objective of the present invention is to provide a resilient sandal wedge and sandal formed therewith, both having all of the advantages of prior art devices and more, and none of the disadvantages.

Yet another objective of the present invention is to provide a wedge of the type described wherein the sole and vamp of the sandal can be directly attached to the wedge.

Yet another objective of the present invention is to provide a wedge of the type described wherein the body and bottom portions have a plurality of recesses extending therein to provide cushioning resiliency to the wedge when the user applies pressure during use.

Another objective of the present invention is to provide a wedge of the type described which can be formed from a single piece of cushioning material.

Thus, there has been outlined, rather broadly, the more important features of the invention in order that the detailed description that follows may be better understood and in order that the present contribution to the art may be better appreciated. There are obviously additional features of the invention that will be described hereinafter and which will form the subject matter of the claims appended hereto. In this respect, before explaining several embodiments of the invention in detail, it is to be understood that the invention is not limited in its application to the details and construction and to the arrangement of the components set forth in the following description or illustrated in the drawings. The invention is capable of other embodiments now being practiced and carried out in various ways.

It is also to be understood that the phraseology and terminology herein are for the purpose of description and should not be regarded as limiting in any respect. Those skilled in the art will appreciate the concepts upon which this disclosure is based and that it may readily be utilized as a basis for designating other structures, methods and systems for carrying out the several purposes of this development. It is important that the claims be regarded as including such equivalent constructions insofar as they do not depart from the spirit and scope of the present invention.

So that the manner in which the above-recited features, advantages and objects of the invention, as well as others which will become apparent, are obtained and can be understood in detail, a more particular description of the invention briefly summarized above may be had by reference to the embodiment thereof which is illustrated in the appended drawings, which drawings form a part of the specification and wherein like characters of reference designate like parts throughout the several views. It is to be noted, however, that the appended drawings illustrate only preferred and alternative embodiments of the invention and are, therefore, not to be considered limiting of its scope, as the invention may admit to additional equally effective embodiments.

DETAILED DESCRIPTION OF THE PREFERRED EMBODIMENT

Figure 7:
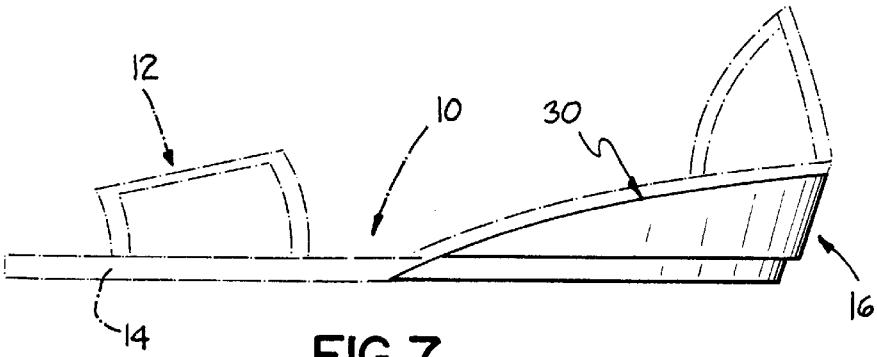
FIG. 7 is a side elevational view of the wedge comprising the present invention and positioned in combination with the sole and vamp of a sandal combined therewith.

Referring now to the drawings and particularly to FIG. 7, a sandal wedge combination shown generally as 10 illustrates the attachment of a sandal construction or vamp 12 in combination with the sole 14 encapsulating a resilient wedge shown generally as 16.

Figure 1:
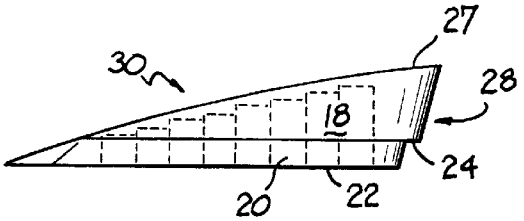
FIG. 1 is a side elevational view of the wedge of the present invention.
Figure 2:
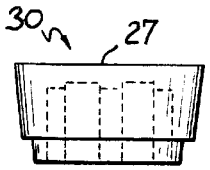
FIG. 2 is a rear end elevational view of the wedge shown in FIG. 1.
Figure 3:
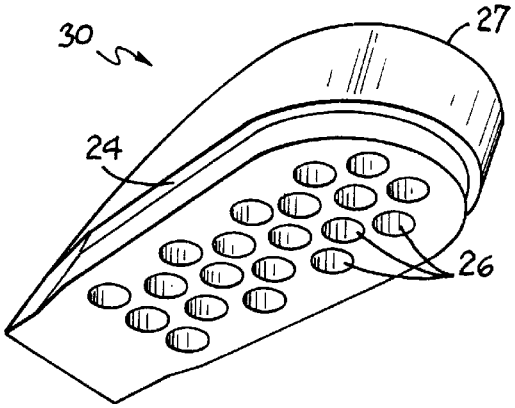
FIG. 3 is a perspective view of the wedge shown in FIGS. 1 and 2.
Figure 4:
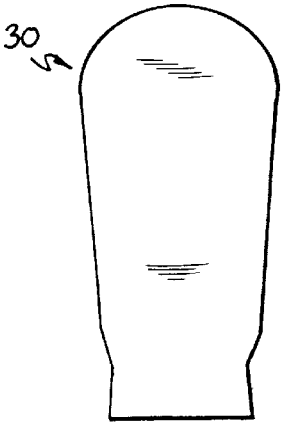
FIG. 4 is a bottom view of the wedge shown in FIGS. 1, 2 and 3.
Figure 5:
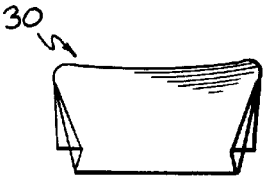
FIG. 5 is a front elevational view of the wedge shown in FIGS. 1, 2, 3 and 4.

Wedge 16 has a wedge-shaped body portion 18, a substantially flat bottom portion 20 having a lower surface 22 and a perimeter. As shown in FIGS. 1–3, the wedge-shaped body portion 18 is positioned adjacent to and above the substantially flat bottom portion 20 and a portion of the body portion 18 extends beyond the perimeter of the bottom portion 20. A recess 24 defines the junction of body portion 18 with bottom portion 20 and, as shown in FIGS. 1 and 3, is located below the portion of the body portion extending beyond the perimeter of the bottom portion 20 and along the perimeter of the bottom portion.

A plurality of holes or recesses 26 extend from the bottom portion lower surface 22 through bottom portion 20 and partially through body portion 18. Recesses 26 can be of any configuration but are most efficiently provided when circularly formed. Since each recess represents an empty opening in a portion of the wedge combination 10, they provide a cushioning resiliency to the wedge when the sandal user applies pressure on the upper or foot-bearing surface 27 of the wedge during use.

Figure 6:
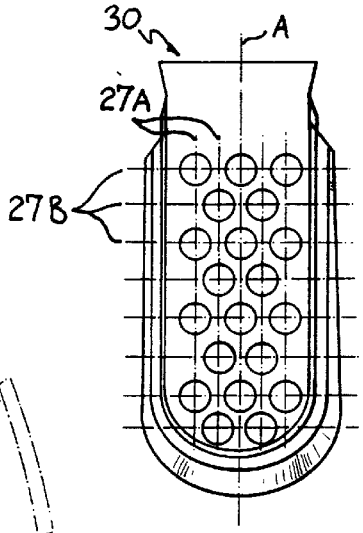
FIG. 6 is a plan view of the wedge shown in FIGS. 1, 2, 3, 4 and 5.

As shown most clearly in FIGS. 3 and 6, the recesses 26 are preferably arranged in a matrix and extend from the bottom portion lower surface 22 as described above. In one embodiment, the recesses 26 are aligned in two series of adjacent parallel lines 27A and 27B. The adjacent parallel lines 27A of one series extend generally parallel to a longitudinal axis A of the wedge 16. The adjacent parallel lines 27B of the other series extend generally transverse to the longitudinal axis A of the wedge 16. Preferably, the number of recesses 26 in adjacent lines 27A extending parallel to the longitudinal axis A of wedge 16 is the same (e.g., four (4) recesses in each adjacent line 27A), while the number of recesses 26 in adjacent lines 27B extending transverse to the longitudinal axis A of wedge 16 varies (e.g., two (2) or three (3) recesses in each adjacent line 27B). The recesses 26 in adjacent lines 27A extending parallel to the longitudinal axis A of wedge 16 are-preferably offset relative to each other. The recesses 26 in adjacent lines 27B extending transverse to the longitudinal axis A of wedge 16 are also preferably offset relative to each other. As shown most clearly in FIGS. 1 and 2, the recesses 26 each have a longitudinal axis which extends at an angle relative to the foot-bearing surface 27 of the wedge 16.

Wedge 10 may be formed of any number of materials so long as the desired resiliency is achieved after recesses 26 are placed therein. It has been quite satisfactory to use a polymeric material for wedge 10 in most sandal constructions.

As various changes can be made in the above-referenced construction without departing from the scope of the invention, it is intended that all matter contained in the description or shown in the accompanying drawings shall be interpreted as illustrative and not in a limiting sense.

What is claimed is:

1. A resilient wedge for use with a sole and vamp comprising:

a wedge-shaped body portion; a substantially flat bottom portion associated with the body portion, the bottom portion having a lower surface and a perimeter; wherein the body portion and bottom portion define a junction between the body portion and the bottom portion and wherein said body portion extends beyond the perimeter of the bottom portion to form an extending body portion; a recess defining the junction of the body portion with the bottom portion below the extending body portion and along the perimeter of the bottom portion; and a plurality of axially elongated recesses, each having a different axis, extending from the bottom portion lower surface through the bottom portion and partially through the body portion, the recesses providing a cushioning resiliency to the wedge when a user applies pressure on the wedge during use.

2. The wedge as claimed in claim 1 wherein the wedge has an elevated rear portion and a front lower portion, said elevated rear portion tapering downwardly to said front lower portion.

3. The wedge as claimed in claim 2 wherein the wedge is formed of a polymeric material.

4. The wedge as claimed in claim 2 wherein the plurality of axially elongated recesses are positioned across the bottom portion lower surface of the rear elevated portion and the front lower portion of the wedge.

5. The wedge as claimed in claim 4 wherein each axially elongated recess extends upwardly from the bottom portion lower surface and partially through the body portion to a pre-determined recess depth, said recess depth varying to extend partially through the body portion of the front lower portion and the rear elevated portion.

6. The wedge as claimed in claim 5 wherein said recess depth is largest at the rear elevated portion and is smallest at the front lower portion, said recess depth gradually decreasing as the rear elevated portion tapers downwardly toward the front lower portion.

7. The wedge as claimed in claim 1 wherein the wedge is formed of a polymeric material.

8. The wedge as claimed in claim 1 wherein each axially elongated recess defines an empty opening extending from the bottom portion lower surface through the bottom portion and partially through the body portion for providing a cushioning resiliency to the wedge when a user applies pressure on the wedge during use.

9. The wedge as claimed in claim 8 wherein each axially elongated recess has a circular cross-sectional shape.

10. The wedge as claimed in claim 1 wherein said wedge-shaped body portion has a foot-bearing surface, each of said axially elongated recesses having a longitudinal axis disposed at an angle relative to said foot-bearing surface.

11. The wedge as claimed in claim 1 wherein said axially elongated recesses are arranged in a matrix.

12. The wedge as claimed in claim 11 wherein said axially elongated recesses are arranged in a plurality of adjacent parallel lines.

13. The wedge as claimed in claim 12 wherein said adjacent parallel lines extend generally transverse to a longitudinal axis of said wedge.

14. The wedge as claimed in claim 13 wherein said axially elongated recesses of one line are offset relative to axially elongated recesses of a parallel adjacent line.

15. The wedge as claimed in claim 12 wherein said adjacent parallel lines extend generally parallel to a longitudinal axis of said wedge.

16. The wedge as claimed in claim 15 wherein said axially elongated recesses of one line are offset relative to axially elongated recesses of a parallel adjacent line.

17. A sandal comprising: a sole; a vamp; and a wedge positioned between the sole and the vamp, the wedge including a wedge-shaped body portion, a substantially flat bottom portion associated with the body portion, the body portion having a lower surface and a perimeter, wherein the body portion and the bottom portion define a junction between the body portion and the bottom portion and wherein said body portion extends beyond the perimeter of the bottom portion to form an extending body portion; a recess defining the junction of the body portion with the bottom portion below the extending body portion and along the perimeter of the bottom portion, and a plurality of axially elongated recesses, each having a different axis, extending from the bottom portion lower surface through the bottom portion and partially through the body portion, the recesses providing a cushioning resiliency to the wedge when the sandal a user applies pressure on the wedge during use.

18. The sandal as claimed in claim 17 wherein the wedge has an elevated rear portion and a front lower portion, said elevated rear portion tapering downwardly to said front lower portion.

19. The sandal as claimed in claim 18 wherein the wedge is formed of a polymeric material.

20. The sandal as claimed in claim 17 wherein the wedge is formed of a polymeric material.

* * * * *

UNITED STATES PATENT AND TRADEMARK OFFICE

CERTIFICATE OF CORRECTION

PATENT NO. : 5,896,678
DATED : April 27, 1999
INVENTOR(S) : Michael H. Ganon

It is certified that error appears in the above-identified patent and that said Letters Patent is hereby corrected as shown below:

Column 3,
Line 37, two paragraphs have been omitted from the PTO document, as follows:

> Wedge 10 has an elevated rear portion 28 and a front lower portion 30 as best shown in Figs. 1 and 3. Wedge 10 tapers downwardly from rear portion 28 to front lower portion 30 so that front lower portion 30 eventually tapers and blends into the joined sole 14.
>
> Sole 14 is cooperatively secured to wedge 10 along the defining recess 24 in a conventional manner, the securement being either by the cement or mechanical affixing means commonly found in the sandal industry.

Signed and Sealed this

Fifth Day of March, 2002

*Attest:*

*Attesting Officer*

JAMES E. ROGAN
*Director of the United States Patent and Trademark Office*